US005975938A

United States Patent [19]

Libby

[11] Patent Number: 5,975,938

[45] Date of Patent: Nov. 2, 1999

[54] QUICK CONNECT ELECTRICAL CONNECTOR FOR MULTI CONDUCTOR INSULATED CABLE WIRING

[75] Inventor: Robert A. Libby, 412 Oakland Ave., Williamsport, Pa. 17701

[73] Assignee: Robert A. Libby, Williamsport, Pa.

[21] Appl. No.: 09/090,063

[22] Filed: Jun. 3, 1998

[51] Int. Cl.[6] ..... H01R 4/24

[52] U.S. Cl. ..... 439/410

[58] Field of Search ..... 439/409, 410, 439/417, 418, 725

[56] References Cited

U.S. PATENT DOCUMENTS

| | | | |
|---|---|---|---|
| 1,171,710 | 2/1916 | Freixas | 439/410 |
| 3,641,472 | 2/1972 | Phillips, Jr. . | |
| 3,716,651 | 2/1973 | Werner . | |
| 3,828,113 | 8/1974 | Bourne . | |
| 4,029,383 | 6/1977 | Harding | 439/410 |
| 4,165,443 | 8/1979 | Figart et al. . | |
| 4,268,109 | 5/1981 | Hardesty . | |
| 4,336,418 | 6/1982 | Hoag . | |
| 4,402,564 | 9/1983 | Frantz . | |
| 4,477,141 | 10/1984 | Hardesty . | |
| 4,485,282 | 11/1984 | Lee . | |
| 4,634,212 | 1/1987 | Boundy et al. . | |
| 4,842,551 | 6/1989 | Heimann . | |
| 4,918,258 | 4/1990 | Ayer . | |
| 4,924,032 | 5/1990 | Akins . | |
| 4,958,048 | 9/1990 | Bell . | |
| 5,015,203 | 5/1991 | Furrow . | |
| 5,064,385 | 11/1991 | Harlow, Jr. . | |
| 5,178,555 | 1/1993 | Kilpatrick et al. . | |
| 5,334,044 | 8/1994 | Falossi et al. . | |
| 5,785,551 | 7/1998 | Libby | 439/535 |

*Primary Examiner*—Neil Abrams
*Assistant Examiner*—Javaid Nasri
*Attorney, Agent, or Firm*—Thomas R. Shaffer, Esq.

[57] ABSTRACT

An electrical connector is provided which has a body having a opening therein sized to receive an unstripped end of insulated electrical cable of the type having at least two individually insulated conductors which are encased in an outer sheath. A pair of arm members are pivotally connected opposite sides of the body which are adapted to rotate between and open position and a closed position. A pair of electrically conducting blade members are attached to said arm members. When the arm members are in an open position the blade members do not extend within said cavity and when the blade members are in a closed position said blade members do extend within said cavity. An electrical output is located on the body and electrical pathway provides an electrical connection between said blade members and the electrical output. When the arm members are moved from an open position to a closed position with an unstripped end of insulated electrical cable present in the cavity, the blade members cut through the outer sheath and cut through the insulation of the individually insulated conductors and make an electrical connection with the conductors.

18 Claims, 7 Drawing Sheets

10
12
14
21
24'
50
50'
54
54'
60
60'
70
70'
71
71'
72
72'
80
82
84

QUICK CONNECT ELECTRICAL CONNECTOR FOR MULTI CONDUCTOR INSULATED CABLE WIRING

BACKGROUND OF THE INVENTION

1. Field of the Invention

The present invention relates to an electrical connector for insulated cable. More particularly, it relates to a connector which can be utilized without tools to quickly and effectively make an electrical connection to at least two individually insulated conductors which are encased in an outer sheath of a transversely cut unstripped end of insulated electrical cable.

2. Prior Art

Wiring the various branch circuits of a typical 120 volt AC electrical power distribution system is a time consuming and labor intensive job. This is the case, in part, because individual attention is required to the placement and the attachment of every cable, junction box, plug receptacle, fixture, switch and the like, as well as every termination of every conductor associated therewith. In addition, accommodation often must be made for the fact that other building operations are going on concurrently with wiring, such as the installation of wall panels.

In construction of a new home, for example, wiring is completed in stages. After rough framing and prior to attachment of wall panels to the frame (e.g., dry wall or plaster), most or all of the power distribution cables are installed between a main service panel or breaker panel at a service entrance coupled to the utility company, and the locations of various outlet receptacles, switches, fixtures and the like. Each receptacle, switch, and fixture in the home is a member of a branch circuit connected to a circuit breaker in the main service panel. Each branch circuits typically encompassing a plurality of receptacles, switches and/or fixtures that are related to one another by function or by general location.

The term "receptacle" in this context generally refers to a standard duplex receptacle operable to receive a standard 120 volt AC two prong or three prong grounded plug, or similarly to a 240 volt outlet suitable for appliances, including those equipped with ground fault interrupters, etc. The term "switch" generally refers to a standard 120 volt AC light switch or the like, as well as three way, four way and dimmer switches, and similar means intended to permit the resident or user to control loads coupled to the branch circuit. The term "fixture" generally refers to a lighting fixture or the like, often located in the ceiling, which is wired into the structure of the establishment, as opposed to being coupled to the branch circuit by a flexible cord leading through the living space to a receptacle or the like. Some branch circuits advantageously are wired with a metal sheathed cable commonly called armored BX cable. Armored cable is durable but is difficult to work with, requiring a hacksaw or the like to cut through the armor, and is therefore only used to protect especially vulnerable and/or exposed cable runs. Most 120 volt AC branch circuits are wired using TYPE-NM (non-metallic sheathed) cables with two conductors plus a ground, often called "Romex". Residential and commercial Romex cable typically contains 12 or 14 gauge solid core conductors, depending on current loading requirements.

Cabling with 14 gauge conductors is suitable for branch circuits carrying 15 amps or less. Cabling with 12 gauge conductors is suitable for branch circuits carrying up to 20 amps. Other gauges are of course possible. Each room in the home typically has several receptacles, at least one light switch and one or more lighting fixtures. Electrical codes may define a maximum spacing between receptacles or a minimum number per room. Preferably after rough framing, a metal or plastic electrical box is rigidly attached to the framing in the home at each location to have a receptacle, switch, junction box or fixture.

Various specific box structures are available, such as double, triple or quadruple wide boxes, single boxes which can be ganged together, boxes with flanges to facilitate attachment to the framing members, boxes which can be mounted in the ceiling for lighting fixtures, weatherproof boxes for outdoor use, as well as junction boxes for coupling two or more cables.

One or more cables are routed through the framing of the house to the appropriate electrical box. The cables are pulled though openings in the rear or sides of the electrical box and usually a cable clamp is provided to secure the electrical cable to the box such that tension cannot disturb wiring connections made within the box. The cable clamp may be attached by a screw disposed adjacent a knock-out plug, or a threaded cable clamp with a nut can be engaged in a hole in the box, for example at a knock-out plug. The cable is fed through an opening in the clamp to leave a sufficient tail for making connections. The clamp is then tightened down so that the cable cannot be pulled back though the opening.

At least one of the cables entering the box is more proximal to the main service panel and is typically called the feed cable. A second cable may be required to route power further to a more distal electrical box or fixture along the branch circuit (such as a switched fixture or a parallel receptacle in the same branch). Initially, the cables are not terminated and the tail length of each cable (approximately one foot) is left dangling though the opening in the front of the box or folded back into the box to be out of the way. The wiring of the switch, receptacle or fixture is typically not done until after wall panel installation and finishing steps are complete. A typical four bedroom home may have more than 40 electrical boxes for receptacles, switches, and fixtures, etc. Each one of these electrical boxes has at least one cable which is subsequently wired to a receptacle element, switch, or fixture mounted in or on the electrical box.

A significant amount of skilled labor is required to properly mount wall panels on framing members with previously attached protruding electrical boxes. Electrical connections between and among the cable conductors and the terminals of each switch or receptacle element are then completed one conductor at a time. Several steps are required to complete each receptacle. First, the outer sheath of the electrical cable is slit and removed with a cable ripper which has a small cutter designed to slice though the outer sheathing without damaging the insulated conductors within. A knife can be used for this purpose, however the risk of damaging the insulated conductors is increased. The outer sheathing, such as an outer plastic and inner paper wrap, are cut away, two expose the conductors inside the cable. Two or three of the conductors have color coded insulation, white insulation denoting the neutral conductor, black insulation the hot conductor, and red, if provided, denoting a switched conductor. The remaining conductor is usually an uninsulated ground conductor.

The inner insulation is stripped from the ends of the hot and neutral conductors as preferably using a wire stripper which is adjusted to cut though the insulation without nicking the conductor, but also possibly with diagonal cutters or a knife. Although the conductors are rather durable, a nick at the end of the inner insulation can severely weaken the conductor and lead to failure. The hot and neutral conductors are formed into a hook with a pair of needle nose pliers large enough to conform to the diameter of terminal screws located on the side of a typical switch or receptacle. The screws are also typically color coded, with the silver colored screw denoting neutral and a copper (gold) colored screw denoting hot (alternatively copper and black may be used, respectively). The appropriate screw for the respective conductor is loosened on the switch or receptacle device. The hook formed in the conductor is placed around the screw under the screw head and preferably pinched down. The hook should be oriented in the proper direction (i.e., wrapping clockwise for a right-handed screw thread) so that the wire hook is not opened or forced out from under the screw head as the screw is tightened.

Alternatively the receptacle can be "backwired," which involves inserting stripped straight lengths of the conductors endwise into openings with spring contacts that bear against the stripped conductors. Duplex receptacles capable of backwiring are available, for example, from Leviton Manufacturing Co., Little Neck, N.Y.; and GE Wiring Devices, Warwick, R.I.; etc. The ends of the conductors are stripped over the precise length needed to fit in the openings such that the insulation behind the stripped end reaches just to the surface of the opening. Such receptacles generally provide a strip gauge molded into the back of the receptacle which indicates the proper length of insulation to be stripped. If too much insulation is stripped from the conductor, the stripped end bottoms out in the opening and a portion of the bare conductor remains exposed. If too little insulation is stripped from the conductor the conductor may not be adequately retained in the hole. Of course, it remains necessary with backwired devices to ensure that the proper conductor (hot or neutral) is placed in the corresponding opening.

The uninsulated ground wire must also be attached to the ground terminal of the receptacle. If the electrical box is made of metal, the box must be grounded by a connection to the ground terminal or to the ground conductor. Typically, the ground conductor is simply routed around a screw located inside the box (e.g., the cable clamp screw) and then to the ground terminal of the receptacle. When two or more cables are routed to the box, a different grounding arrangement must be used. After routing at least one ground conductor to the box, the remaining ground conductors are twisted together and capped with a wire nut. A special wire nut (usually green in color) with a hole for a pigtail can be used to hold the ground conductors together. A pigtail of appropriate length, with a stripped end if insulated, is fed into a small hole in the closed end of the wire nut, the large open end of the wire nut is then twisted over the ground conductors and the pigtail is attached to the grounding terminal of the receptacle. Alternatively a crimp connector and pig tail lead can be used to join the ground conductors together. The conductors are folded back neatly and the receptacle is pushed into the electrical box. Two retaining screws are installed to hold the receptacle in the box. Care must be taken to center and align the receptacle at the correct position in the electrical box. Once the receptacle is properly oriented in the box the cover plate can be attached.

These routine steps involve substantial time and care to accomplish properly. Adding a second cable to a box multiplies the required steps, particularly when the duplex receptacle is used for two-circuit wiring. Although a duplex receptacle has two outlets which are usually powered from the same source, this is not always the case. Duplex receptacles can have a break-off fin located between the pair of side screws, acting as a bus bar between the pair of side screws. The break-off fin can be removed to electrically isolates the pair of side screws and allows the two individual receptacles to be wired individually, for example so that only one is controlled by a switch. Rooms that do not have a center fixture in the ceiling are often wired with one or more two-circuit receptacles for lamps. Two-circuit receptacles are also used in kitchens, such that load devices which require large amounts of power, such as refrigerators, microwave ovens and toasters, can have a separate branch circuit to accommodate their current requirements while using only one receptacle circuit.

Attempts have been made to simplify the wiring process. U.S. Pat. No. 3,716,651 to Werner discloses a wiring box that has screw terminals for attaching cables and spring clips for attaching receptacles. The receptacles have corresponding prongs which mate with the spring clips. First the box is mounted and wired using the screw terminals. Then the receptacle is pressed into the box such that the prongs engage in the spring clips thereby making electrical contact. Although Werner eliminates wiring between the box and the receptacle, the receptacle must still be installed and aligned in the box, and the box itself must be wired in a manner similar to a conventional receptacle.

U.S. Pat. No. 4,485,282 to Lee discloses a plug-in system for wiring wall outlets and wall switches. The system has a base plate which is wired by inserting the stripped ends of the conductors into frictionally engaging electrical contacts in a manner similar to backwiring a duplex receptacle. The base plate has two openings in the front each opening having a series of electrical contacts that are operable to engage a plug-in module. Once the base plate is wired, the proper module is selected, such as an outlet or a switch, to be inserted into the openings.

U.S. Pat. No. 4,165,443 to Figart et al also discloses a system which has a backwired baseplate and separate plug-in modules for receptacles and switches. Figart also discloses several labeled backwire terminals which simplify the wiring connections. For example two terminals are labeled "to fixture" and "power" to identify which cable should be connected to the box if a switch module is to be installed. Other terminals are marked to aid in the wiring of three way switches an four way switches. The stripped ends of the conductors are inserted into the appropriately marked terminals. The appropriate three way or four way switch modules are then plugged into the baseplate to complete the circuit. This type of system simplifies the interconnection for more sophisticated wiring situations, however there is added complexity due to having an electrical box having a baseplate and separate plug-in modules, and attention is required to comply with the labeled requirements to couple certain conductors to certain connections.

U.S. Pat. No. 4,336,418 to Hoag, U.S. Pat. No. 4,918,258 to Ayer and U.S. Pat. No. 4,924,032 to Akins also disclose wiring systems in which connections are made by inserting the stripped ends of the conductors into frictionally engaging electrical contacts similar to backwiring a duplex receptacle.

U.S. Pat. No. 4,842,551 to Heimann discloses a modular plug suitable for connection to an electrical cable. The individual conductors in an electrical cable are stripped and inserted into a first end of the plug. The opposite end of the plug has an interconnector plug which is attached to several short conductors. The interconnector plug is then engaged into a socket in the rear surface of a function module, such as a receptacle or a switch. After the interconnector plug is engaged in the function module, the function module must be aligned and installed in the electrical box.

U.S. Pat. No. 3,641,472 to Phillips Jr., U.S. Pat. No. 5,178,555 to Kilpatrick et al., and U.S. Pat. No. 5,015,203 to Furrow disclose 120 volt AC electrical boxes with a front wall having standard three-prong receptacles and a rear wall having a male terminal that connects to female plugs. In Phillips, the female plug is a standard three-prong receptacle typical of 120 volt AC outdoor extension cords. Kilpatrick et al. and Furrow disclose for the modular plug a different type, namely multi-pin connector types which are customary in connecting together computer hardware. These references all disclose female modular plugs which would at best be laboriously attachable to an end of Romex cable or like conductor-cable.

U.S. Pat. No. 5,064,385 to Harlow, Jr., discloses in FIG. 2, a modular junction box which is releasably connectable to a modular outlet box. The junction box has a socket for insertion of a modular plug on an end of insulated electrical cable. The modular plug requires the conductors of the electrical cable to be stripped of insulation before assembly. Harlow, Jr. also discloses a wire stripper in designed specifically to strip the individual conductors in preparation for attachment of the modular plug.

U.S. Pat. No. 4,958,048 to Bell, discloses a modular electrical wiring system which includes outlet boxes which include female receptacles adapted to receive male plugs provided on insulated cables (see FIG. 2).

U.S. Pat. No. 3,828,113 to Bourne, discloses an electrical receptacle or switch which is adapted to receive an electrical cable 6 which has stripped conductors 18 thereon.

U.S. Pat. No. 4,402,564 discloses an example of a connector for flat flexible cables. As shown in FIG. 1, an example of a mating female receptacle 12 and mating male plug 14 is disclosed.

In U.S. Pat. No. 4,634,212 to Boundy et at., a terminal block mount is disclosed which permits a terminal block to be snapped onto the terminal block receiving aperture. This arrangement is best shown in FIG. 1.

Finally, U.S. Pat. No. 4,268,109 to Hardesty and U.S. Pat. No. 5,334,044 to Falossi et al., discloses couplers typically utilized for telephone cords. These references show yet another type of female couplers and male plugs which can be utilized to make electrical connections.

As disclosed in my co-pending application, U.S. Ser. No. 08/411,950, filed Mar. 28, 1995, it is desirable to reduce and simplify the number of steps required in wiring an electrical power distribution system and to make electrical connections without the need to strip the ends of the individual conductors in an electrical cable. In FIGS. 13*a* through 13*d* of my co-pending application, I show and describe a structure and device to make an electrical connection to a transversely cut unstripped end of insulated electrical cable having at least two individually insulated conductors which are encased in an outer sheath. With that system, a special pair of pliers is utilized to drive generally parallel spaced apart individual blade members downwardly through the outer sleeve of the cable, through the conductor insulation and into juxtaposition and electrical connection, respectively, with each of the wire conductors. While my earlier system is functional and an improvement over the prior art, there remains a need for a more effective, more expedient and less expensive connector which can make a connection to an unstripped insulated cable.

SUMMARY OF THE INVENTION

It is an object of the present invention to provide a connector with a cavity sized to receive an unstripped end of an electrical cable and which efficiently makes an electrical connection between the cable and an output means of the connector which can be adapted for compatible connection with a variety of existing prewired junction boxes, plug receptacles, fixtures, switches and the like, such as for examples, these described in the patents identified above.

It is an object of the invention to provide an electrical connector which, by providing one embodiment with a male output and one embodiment with a female output, allows for fast, safe and efficient splicing together of unstripped cable ends.

These and other objects are accomplished by the present invention, which, in its simplest form provides an electrical connector for insulated cable comprising a body, a pair of arm members, a pair of electrically conducting blade members, an electrical output means and an electrical pathway between the blades and the output means.

The a body formed of an electrically insulating material and has a first end portion and opposite side portions. The body has an opening in the first end portion which forms a cavity into the body. The cavity is sized to receive an unstripped end of insulated electrical cable having at least two individually insulated conductors which are encased in an outer sheath. The cavity in the body has a generally elongated cross sectional configuration and said cavity extends into the body along a centrally located longitudinal axis. Preferably, the cavity is more narrow in cross section at locations more distant from the opening so that an unstripped end of insulated electrical cable will be retained by a greater amount of friction as the cable is inserted deeper into the cavity.

Preferably, at least on pair of longitudinally extending ridges are provided on an inner surface of the cavity. The ridges aid in providing frictional engagement of an unstripped end of insulated electrical cable when inserted into the cavity. Further, the ridges aid in causing the individually insulated conductors of an unstripped end of insulated electrical cable to be located and secured in a desired location within the cavity when said cable is inserted into the cavity. Preferably, the ridges have a generally triangular cross sectional configuration and are provided in the cavity at locations to engage the sheath of cable at locations between adjacent conductors located within the cable.

A pair of electrically insulating arm members are pivotally connected at one end thereof to opposite side portions of the body. The arm members are adapted to rotate about an axis of rotation between and open position and a closed position. Preferably, the arm members are generally U-shaped in configuration and when in a closed position lock into the body portion. When in a closed position, the arm members preferably lie within a recess provided in the body portion thereby creating a generally, smooth co-planer outer surface at the points of intersection between the body and the closed arms.

A pair of electrically conducting blade members are attached to said arm members to revolve about said axis of rotation. The blade members preferably have a generally disk shaped configuration and are attached to the arm members so that center points of said blade members are spaced from the axis of rotation of the arms. With this arrangement, when the arm members are in an open position, the blade members do not extend within the cavity and when the blade members are in a closed position, the blade members do extend within said cavity. The arm members and the blade members can, however, be formed of any shape and configuration (such as, for example, a square, rectangle or triangle or any imaginable irregular shape blade) so long as:

(1) the blade members do not extend into the cavity when the arm members are in the open position;

(2) when the arm members are moved from an open position to a closed position with an unstripped end of insulated electrical cable present in the cavity, the blade members cut through the outer sheath of the cable and also cut through the insulation of the individually insulated conductors; and (3) the blades move to a location where said blade members are in electrically contact with said conductors when the arm members are in the closed position.

Preferably, the blade members are provided with at least one tooth portion to aid in cutting through said outer sheath of the cable and through said insulation of a conductor.

An electrical output means is also provided on the body to provide a means to utilize the connector with prewired electrical boxes, switches, receptacles and the like and to allow for splicing together of two unstripped wire ends. The output means typically will take the form of either a male plug member or a female receptacle member which is sized and configured to be compatible with other components of the electrical system being utilized. Thus, the output means is designed to be compatible with the existing module or pre-wired electrical outlet, switch or other electrical devices which will be utilized in wiring the structure. Alternatively, a snap fit adapter can be utilized to make the output means of the present invention compatible with any existing module or pre-wired electrical device. The adapter has an input means (either a male plug or female receptacle) adapted to mate with the output means of the connector. The adapter also has an output (either a male plug or female receptacle) adapted to mate with the existing module or pre-wired electrical device.

Finally, an electrical pathway means is utilized to provide an electrical connection between the blade members and the electrical output means. Preferably, the electrical pathway is formed by a pair of electrically conducting tubular members connected to and extending from a hole located near the center of each blade member to the output means. The tubular members also preferably form the output means consisting of a female receptacle.

In the preferred embodiment of the invention, an electrically conducting ground bar member secured within the cavity. The bar member extends longitudinally within the cavity parallel to said longitudinal axis. The bar member is electrically connected to the output means. The bar member is adapted to enter a central portion of an unstripped end of insulated electrical cable and make an electrical connection with an uninsulated ground wire in said cable when such a cable is inserted into said cavity. The bar member also preferably extends from a location near said first end portion of the body to an end portion of the body opposite said first end portion. Preferably, the bar member is provided with a tubular shape at said opposite end portion forming a portion of the output means consisting of a male or female receptacle.

DETAILED DESCRIPTION OF THE PREFERRED EMBODIMENTS

Figure 1:
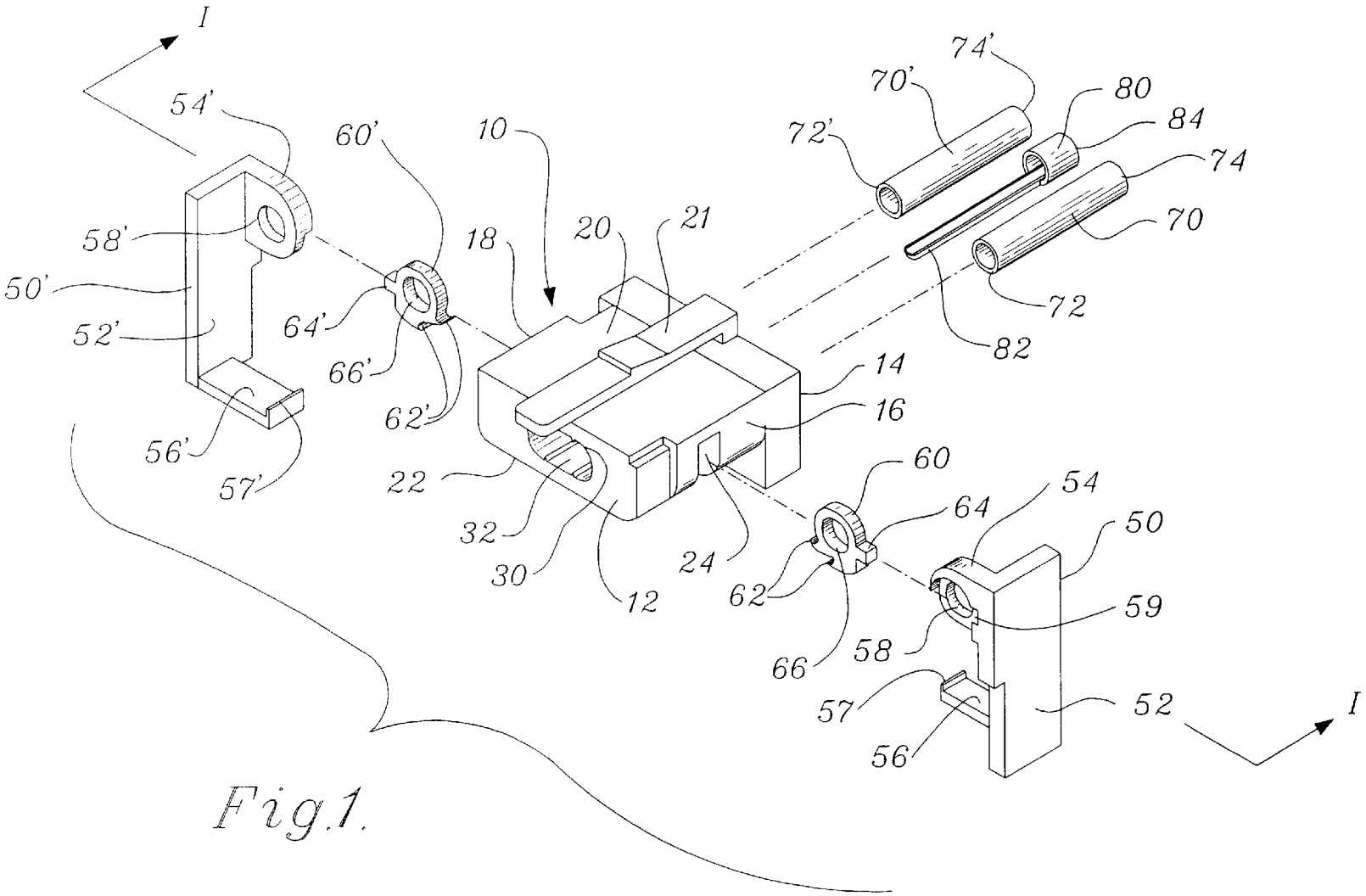
FIG. 1 is an isometric view in exploded form of an electrical connector according to present invention.
Figure 2:
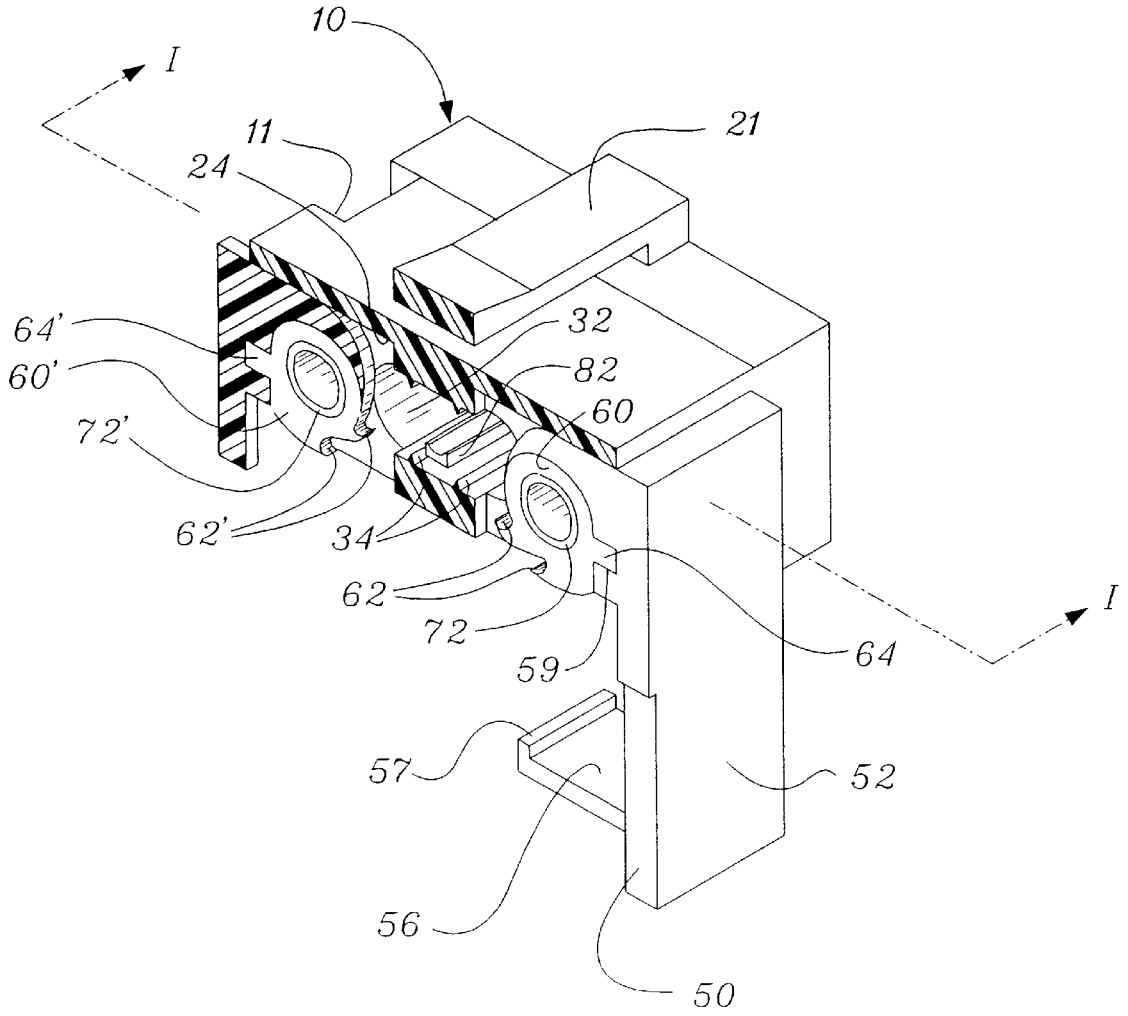
FIG. 2 is an isometric view partially in section of a portion of the electrical connector of FIG. 1 as cut along the line I—I.

Referring to FIGS. 1 through 5, the preferred embodiment of the electrical connector of the present invention includes a body 10 formed of an electrically insulating material. The body 10 has a first end portion 12, opposite side portions 16 and 18, and an opposite end portion 14 (which is opposite end portion 12). The body 10 also has an upper surface 20 which includes a locking clip 21 thereon as well as a lower surface 22. A recess 24 is provided in side portions 16 and 18 to receive and pivotally connect arm members 50 and 50' and attached blade members 60 and 60'.

Figure 4:
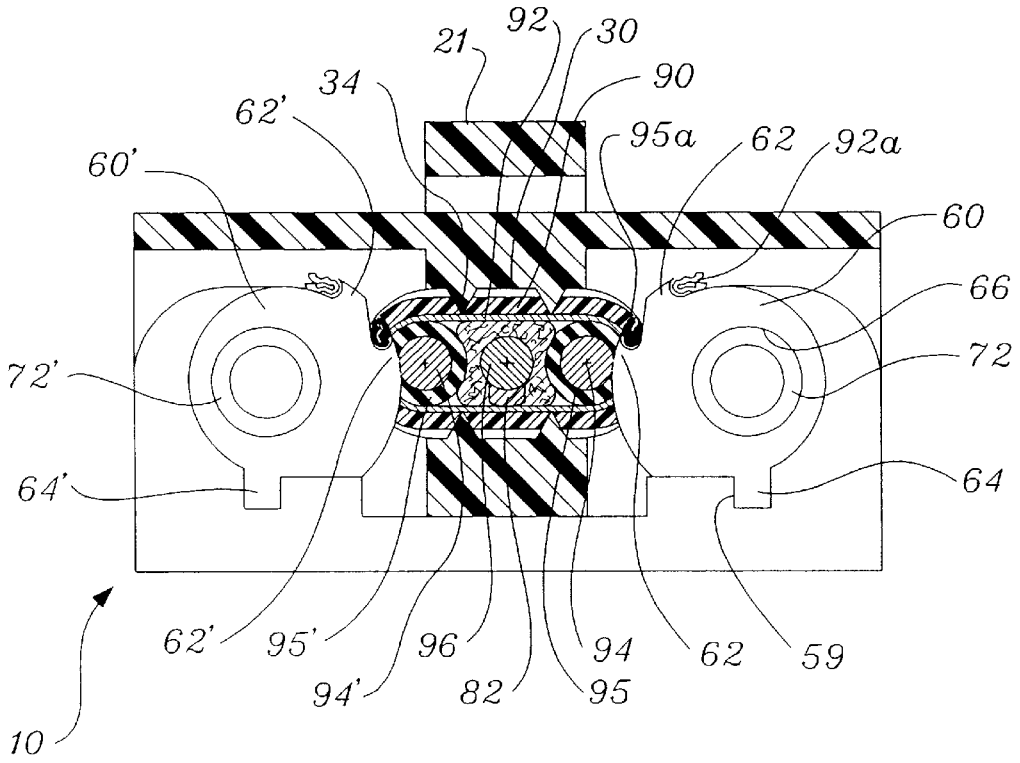
FIG. 4 is a cross-sectional view of the connector as shown in FIG. 3 with the arms in a closed position and also showing an insulated electrical cable having two individually isolated connectors and a ground wire all encased in an outer sheath.

The first end of the housing 12 has an elongate opening 30 therein which forms a cavity 32 in said housing 10. The cavity has a generally elongated cross section of configuration and extends into the body 10 along a centrally located longitudinal axis 35. Preferably, the cavity 32 also is provided with two pairs of longitudinally extending ridges 34, which are provided on an inner surface of the cavity. The ridges 34 aid in providing frictional engagement with an unstripped end of an electrical cable when inserted into the cavity 34. Further, the ridges 34 aid in causing the individually insulated conductors 94, 94' and 96 of an unstripped end of an insulated electrical cable 90 to be located and secured in a desired location within the cavity when said cable 90 is inserted into the cavity 32. This arrangement is best shown in FIG. 4 which shows the ridges 34 being spaced generally between the conductors 94, 96 and 94'. Preferably, ridges 34 have a generally triangular cross-sectional configuration.

As will be obvious, the cavity 32 is sized to receive an unstripped end of an electrical cable 90 which has at least two individually insulated conductors 94 and 94' which are insulated by insulation 95 and 95', respectively, and which are encased in an outer sheath 92. Preferably, the cavity 32 is designed to become more narrow in cross-section at locations which are more distant from the opening 30 whereby an unstripped end of an insulated electrical cable 90 will be retained by a greater amount of friction as the cable is inserted deeper into the cavity.

The electrical connector 10 of the present invention includes a pair of electrically insulated arm members 50 and 50', which are pivotally connected at one end thereof to set opposite side portions 16 and 18 of said body 10 with said arm members 50 and 50' adapted to rotate about an axis of rotation 67 between an open position (FIG. 3) and a closed position (FIG. 4).

Arm member 50 includes a central member 52 and ear portion 54 provided at one end thereof. The ear portion 54 has a hole 58 formed therein. Arm member 50 also includes a locking portion 56 and 57 which extends inwardly from an opposite end of the central member 52 from the ear portion 54. The ear portion 54 has a notch 59 provided therein which is adapted to receive a protrusion 64 of blade member 60.

It will be obvious to those of ordinary skill in the art that arm member 50' is identical in construction to arm member 50 but is positioned on the body in an orientation 180 degrees from that of arm member 50.

A pair of blade members 60 and 60' are attached to said arm members 50 and 50', respectively, and are adapted to revolve about said axis of rotation 67. Blade member 60 and 60' are provided with two teeth 62 and have an opening 66 formed therein. Because of the added material of the teeth member, the center 69 of the blade member 60 and 60' are spaced from the axis of rotation 67. This causes the blade members to have a cam action.

The blade members 60 and 60' are made out of an electrically conducting material and generally have a disc shaped configuration. The blade members 60 and 60' are attached to the arm members 50 and 50' so that the center points of the blade members 69 are spaced from the axis of rotation 67 whereby when the arm members 50 and 50' are in an open position (as in FIG. 3), said blade members 60 and 60' do not extend within said cavity 32. However, when said blade members 60 and 60' are in a closed position, (See FIG. 4) the blade members do extend within said cavity 32.

As best shown in FIG. 4, when the arm members 50 and 50' are moved from an open position to a closed position with an unstripped end of an electrical cable 90 present in the cavity, the blade members 60 and 60' first cut through the outer sheath 92 of electrical cable 90 and thereafter cut through the insulation 95 and 95' of the individually insulated conductors 94 and 94' and move to a final location where said blade members 60 and 60' are in electrical contact with said conductors 94 and 94'.

Still referring to FIG. 4, preferably the teeth are very sharp and are configured, sized and spaced such that the first tooth will cut through the outer sheathing 92 cutting away a small portion 92*a* thereof and will also cut through the insulation 95 of the conductor 94 cutting a small portion 95*a* of said insulation away. The second tooth member 62 is provided to ensure that the outer sheath and insulation are properly cut. This will leave the second tooth member 62 an intimate electrical contact with the conductor 94. An identical operation occurs when arm 50' is moved from an open to a closed position thereby causing blade member 60' to intimately contact conductor 94'.

Figure 5:
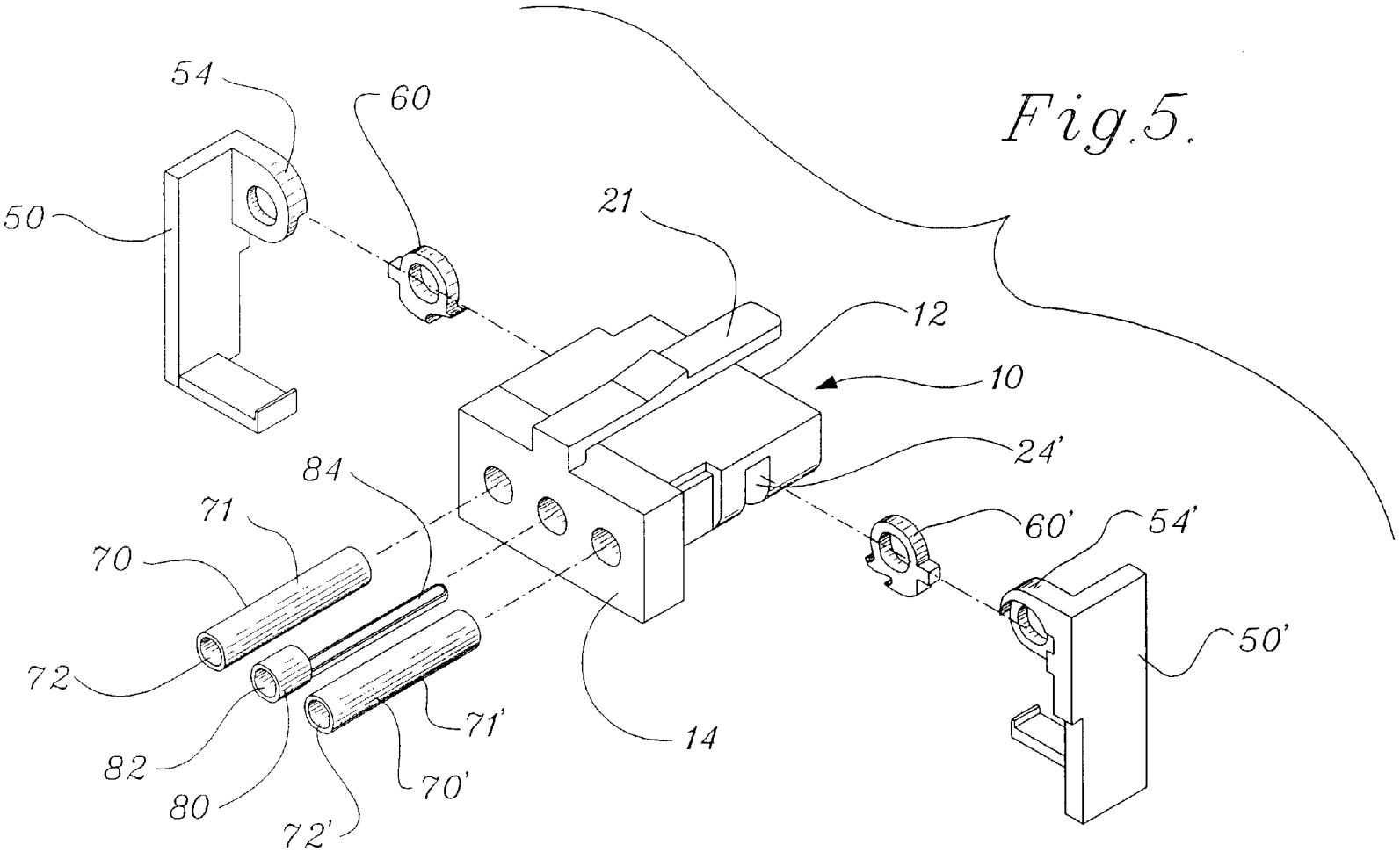
FIG. 5 is an isometric view in exploded form of the connector of FIG. 1 showing a rear portion thereof.

While the operation of the arm members and the blades have been discussed, it is also essential that some type of electrical output means 72, 82 and 72' and an electrical pathway means 70, 80 and 70' be provided. As best shown in FIGS. 1, 4 and 5, a bar means 84 is adapted to enter a central portion of an unstripped end of an insulated electrical cable 90 and make an electrical connection with an uninsulated ground wire 96 in said cable 90 when said cable is inserted in said cavity 32. The bar member 84 is formed of an electrically conducting material and is secured within said cavity 32 in a manner whereby said bar member extends longitudinally within said cavity parallel to said longitudinal axis 35. The bar member 84 is electrically connected to the output means 82.

As best shown in FIGS. 1 and 5, the electrical output means 70, 70' and the electrical pathway means 71, 71' are preferably formed by a pair of electrically conducting tubular members 70 and 70' which extend from a hole 66, 66' in the blade members 60, 60' to the output means 70, 70'. Preferably, said tube members 70, and 70' form a female receptacle in an end portion 14 of the body 10 opposite said first end portion 12.

Similarly, preferably said bar member 84 extends from a location near said first end portion of the body 12 to an end portion of the body 14 opposite said first end portion 12. Further, the bar member 84 is preferably formed with a tubular shape 80 at the opposite end portion 84 forming a portion of the output means 84 consisting of a female receptacle. As is apparent from the figures, the arm members 50 and 50' are generally u-shaped in configuration and when said arm members are in a closed position, locking portions 56, 57 and 56' and 57' lock into the body portion 10. More specifically, preferably there is a recess 11 in body 10 which creates a generally smooth co-planer outer surface at the point of intersection between the body 10 and the closed arms 50 and 50'.

As will now be apparent, the embodiment of the invention shown in FIGS. 1 through 5 relates to an electrical connector which has as output means in the form of a female receptacle. The size, shape, spacing and configuration of the female receptacles can be easily formed to be compatible with any corresponding male plug which may exist on any prewired box, switch, outlet or the like.

Figure 6:
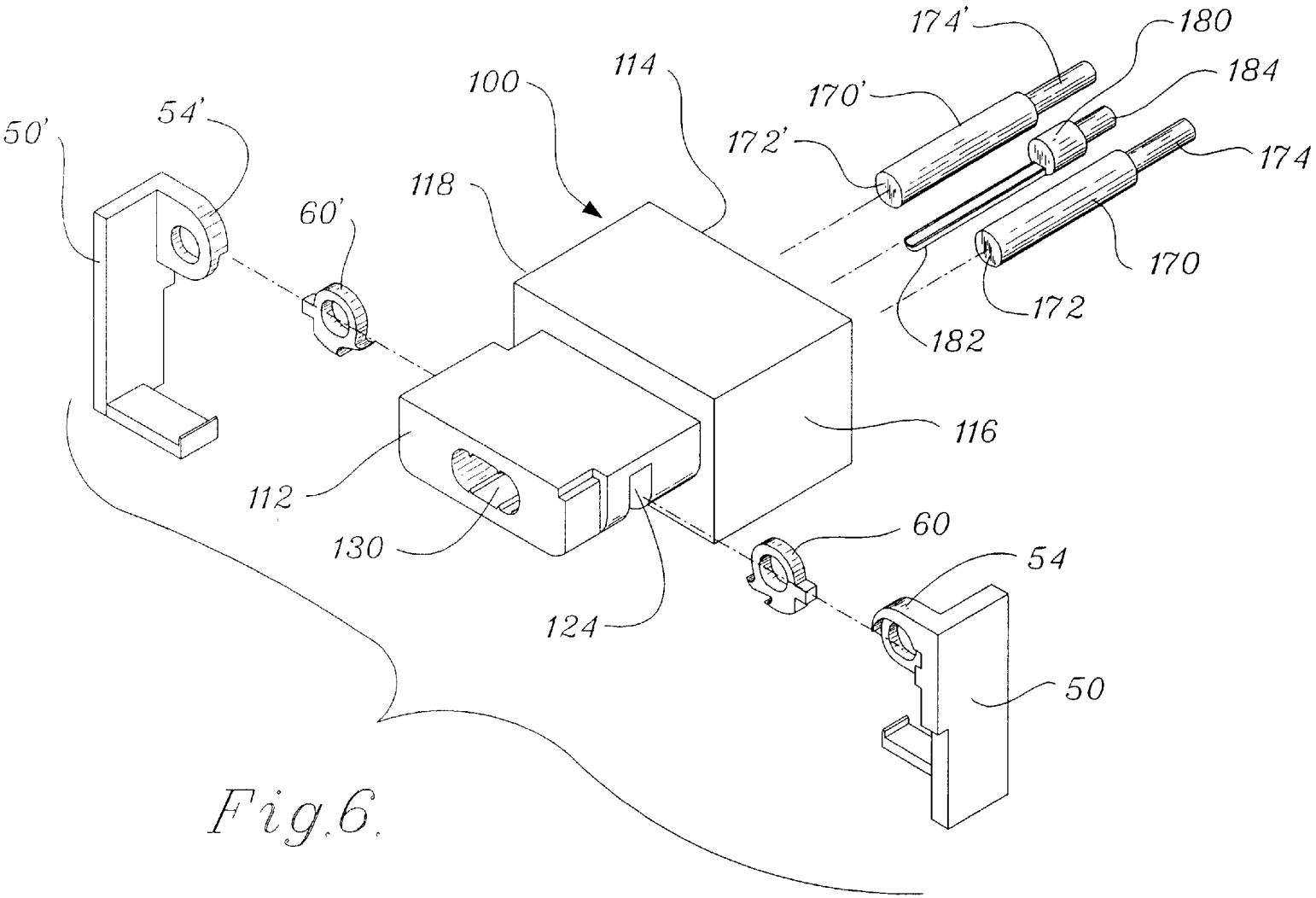
FIG. 6 is an isometric view in exploded form of an alternate embodiment of the present invention which provides a larger housing with male output plugs adapted to receive the connector of FIG. 1 which has a smaller housing with female output connectors.
Figure 7:
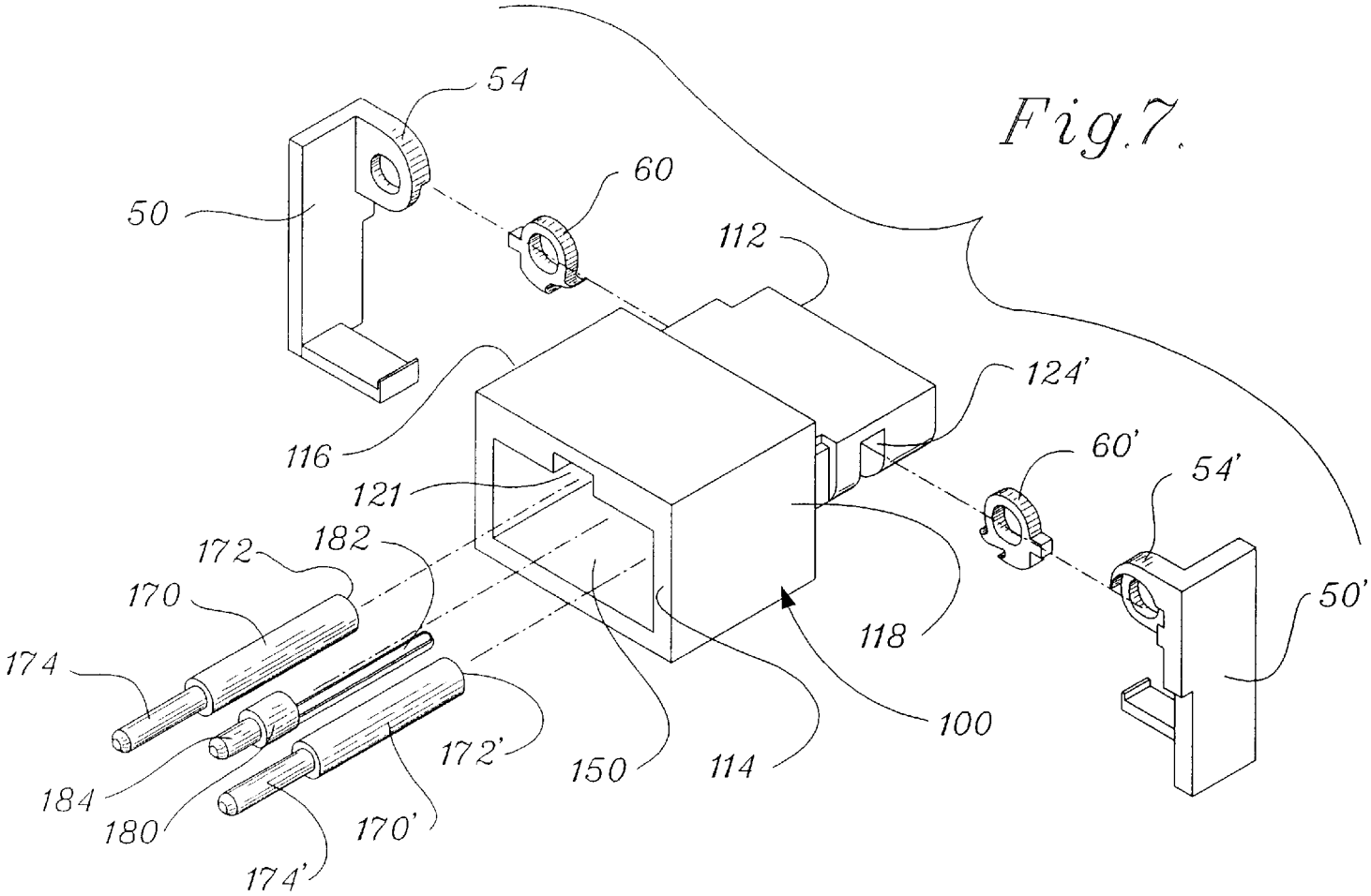
FIG. 7 is an isometric view in exploded form of the connector of FIG. 6 showing a rear view thereof.

It will also be obvious to those skilled in the art that the output means can be formed with a male plug rather than a female receptacle. Such a configuration is shown in FIGS. 6 and 7. In the embodiment shown in FIGS. 6 and 7, the larger body 100 is provided which has an opening 150 and a rear portion 114 thereof and which includes a notch 121 adapted to receive the locking clip 21 of the female receptacle (FIG. 1). The numbering of the components in FIGS. 6 and 7 are identical to that shown in the first embodiment but with the number 100 added to the reference figures. Thus, for example, the first end portion is 112 and the opposite end portion is 114. The opposite side portions are 116 and 118. The arm members 50 and 50' are identical in both embodiments and thus have the same numbers. The output means consist of three male plug members 174, 184 and 174'. As with the female output means, the configuration of opening 150 and the size, shape, spacing and configuration of the male plug members 174, 184 and 174' can be designed to be compatible with any prewired electrical box, switch, outlet or the like.

Figure 3:
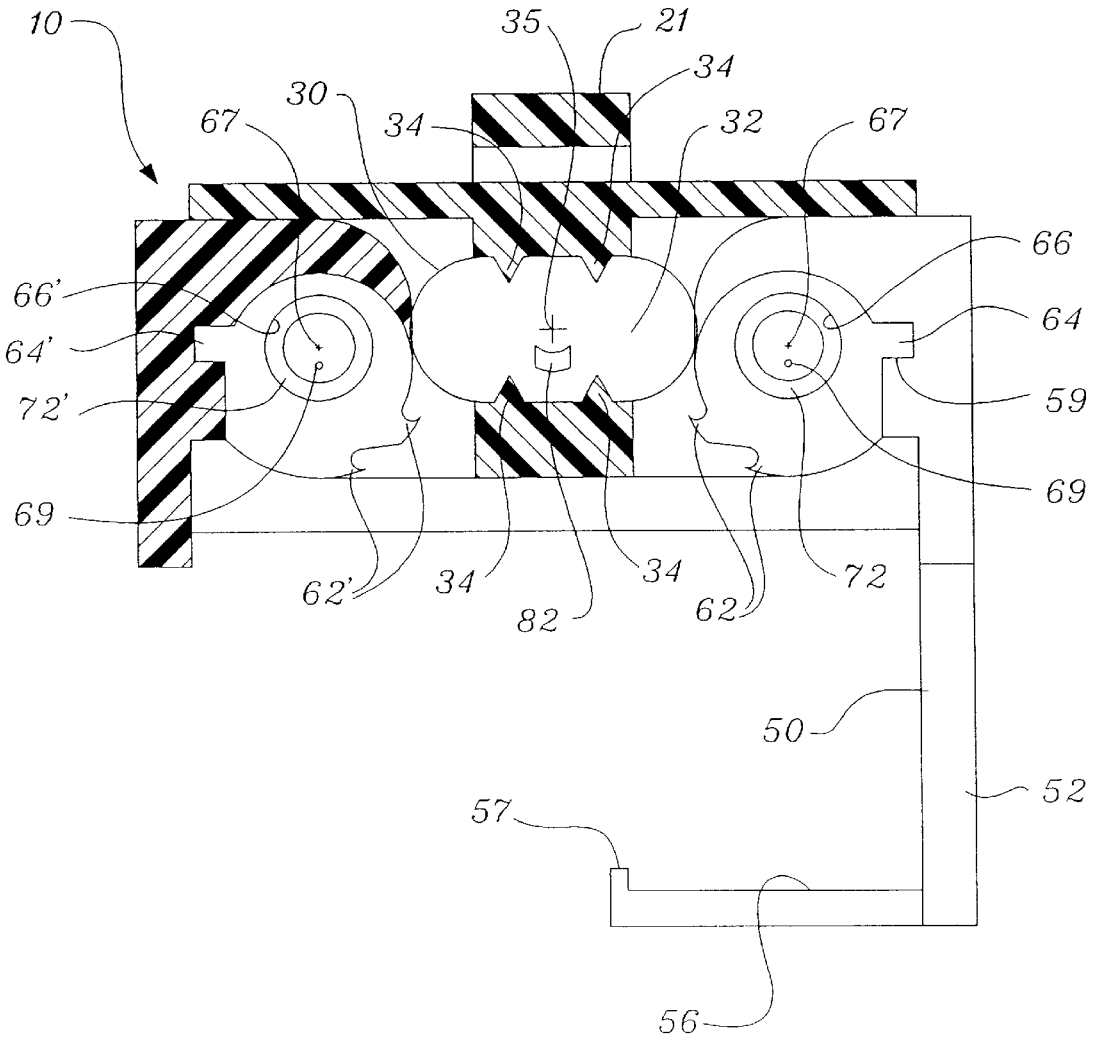
FIG. 3 is a cross-sectional view taken on the line I—I of FIG. 1 showing the connector with the arms in an open position.
Figure 4A:
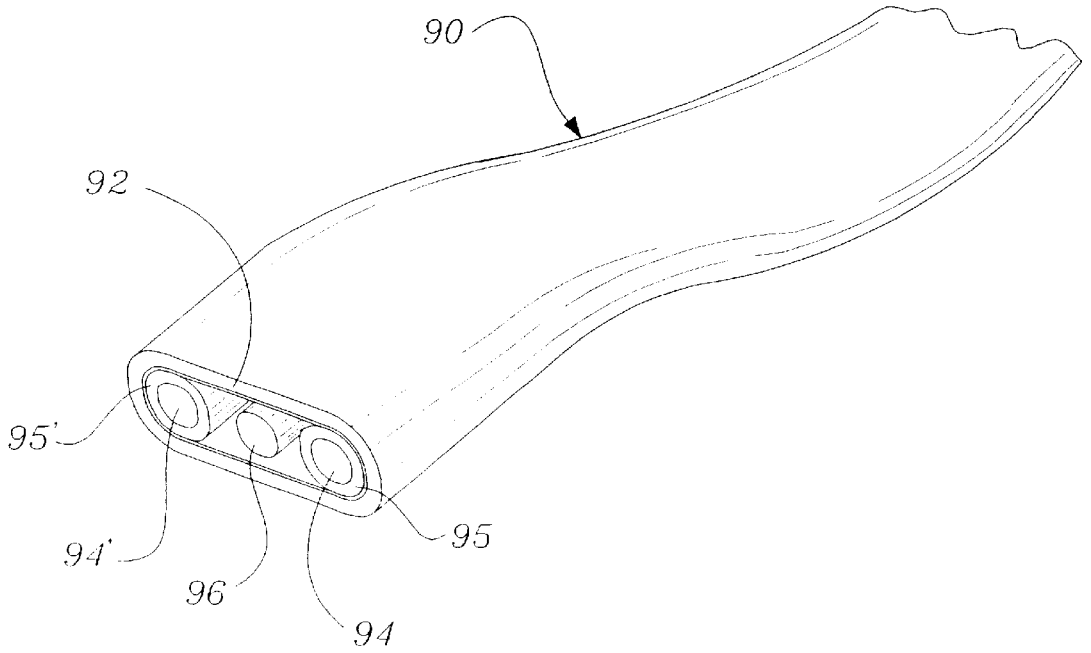
FIG. 4*a*. is an isometric view of an unstripped end of an insulated electrical cable having two individually insulated conductors and a ground wire encased in an outer sheath having an end which has been transversely cut.

In operation, the electrical connector of the present invention is amazingly straight forward and simple to use. The transversely cut end of an electrical cable 90 as shown in FIG. 4*a* which has an outer sheath 92, insulated conductors 94 and 94' having respectively insulation 95 and 95' thereon and including a ground wire 96 is inserted into the cavity 32 of the connector 10 while the arms 50 and 50' are in the open position as shown in FIG. 3. The arms 50 and 50' are then simply closed and snapped into the body portion to lock them into position and an electrical connection is made as previously described as shown in FIG. 4. The entire operation takes only a few seconds and a safe, reliable and efficient electrical connection to an electrical cable is thus made.

It will also be obvious that in the event that it is necessary to splice two wires together, the end of one cable could be inserted to an embodiment of an invention as shown in FIG.

1 and an end of a second cable could be inserted into the embodiment of the invention shown in FIG. 6 and once the arm members were closed and locked, the female output of FIG. 1 would simply be inserted into the opening 150 of the male output means of FIG. 6.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An electrical connector for insulated cable comprising:

a) a body formed of an electrically insulating material, said body having a cavity formed therein sized to receive an unstripped end of insulated electrical cable having at least two individually insulated conductors which are encased in an outer sheath;

b) a pair of electrically insulating arm members pivotally connected to said body with said arm members adapted to rotate about an axis of rotation between an open position wherein said cavity is open to allow insertion of an electrical cable into said cavity and a closed position wherein said cavity is at least partially obstructed;

c) a pair of electrically conducting blade members capable of cutting through said outer sheath and cutting through insulation of said insulated conductors, said blade members attached to said arm members for rotation with said arm members whereby when said arm members are in the open position said blade members do not extend within said cavity and when said blade arm members are in the closed position said blade members do extend within said cavity;

d) electrical output means located on said body; and e) electrical pathway means providing an electrical connection between said blade members and said electrical output means.

2. The electrical connector for insulated cable according to claim 1 wherein when said arm members are moved from the open position to the closed position with an unstripped end of insulated electrical cable present in the cavity, said blade members cut through the outer sheath and cut through the insulation of the individually insulated conductors and make electrical contact with said conductors.

3. The electrical connector for insulated cable according to claim 2 wherein said blade members are provided with at least one tooth portion to aid in cutting through said outer sheath and through said insulation of a conductor of an unstripped end of an insulated electrical cable inserted into said cavity.

4. The electrical connector for insulated cable according to claim 1 wherein said cavity has a generally elongated cross sectional configuration and said cavity extends into the body along a centrally located longitudinal axis.

5. The electrical connector for insulated cable according to claim 4 further comprising an electrically conducting bar member secured within said cavity, said bar member extending longitudinally within said cavity parallel to said longitudinal axis and wherein said bar member is electrically connected to said output means.

6. The electrical connector for insulated cable according to claim 5 whereby said bar member is adapted to enter a central portion of an unstripped end of insulated electrical cable and make an electrical connection with an uninsulated ground wire in said cable when such a cable is inserted into said cavity.

7. The electrical connector for insulated cable according to claim 5 wherein said bar member extends from a location near a first end portion of the body to an end portion of the body opposite said first end portion and wherein said bar member is provided with a tubular shape at said opposite end portion forming a portion of the output means.

8. The electrical connector for insulated cable according to claim 4 wherein at least one pair of longitudinally extending ridges are provided on an inner surface of the cavity to aid in causing individual insulated conductors of an unstripped end an insulated electrical cable to be located and confined in a desired spaced-apart location in the cavity.

9. The electrical connector for insulated cable according to claim 8 whereby said ridges aid in providing frictional engagement of an unstripped end of insulated electrical cable when inserted into the cavity.

10. The electrical connector for insulated cable according to claim 8 whereby said ridges aid in causing said at least two individually insulated conductors of an unstripped end of insulated electrical cable to be located and secured in a desired location within the cavity when said cable is inserted into the cavity.

11. The electrical connector for insulated cable according to claim 8 wherein said ridges have a generally triangular cross sectional configuration.

12. The electrical connector for insulated cable according to claim 8 wherein said ridges are provided in the cavity at locations to engage the sheath of cable at locations between adjacent conductors located within the cable.

13. The electrical connector for insulated cable according to claim 1 wherein said output means is in the form of one of a male plug member and a female receptacle member.

14. The electrical connector for insulated cable according to claim 1 wherein said electrical pathway is formed by a pair of electrically conducting tubular members connected to and extending from a hole located near the center of each blade member to the output means and wherein said tube members also form the output means.

15. The electrical connector for insulated cable according to claim 1 wherein said arm members are generally U-shaped in configuration and wherein said arm members when in the closed position lock into the body portion.

16. The electrical connector for insulated cable according to claim 1 wherein said arm members are generally U-shaped in configuration and wherein said arm members when in the closed position lie within a recess provided in the body portion thereby creating a generally co-planer outer surface at the points of intersection between the body and the closed arms.

17. An electrical connector for insulated cable comprising:

a) a body formed of an electrically insulating material, said body having a cavity formed therein sized to receive an unstripped end of insulated electrical cable having at least two individually insulated conductors which are encased in an outer sheath;

b) a pair of electrically insulating arm members pivotally connected to said body with said arm members adapted to rotate about an axis of rotation between an open position wherein said cavity is open to allow insertion of an electrical cable into said cavity and a closed position wherein said cavity is at least partially obstructed;

c) a pair of electrically conducting blade members attached to said arm members whereby when said arm members are in the open position said blade members do not extend within said cavity and when said said arm members are in the closed position said blade members do extend within said cavity;

d) electrical output means located on said body; and e) electrical pathway means providing an electrical connection between said blade members and said electrical output means wherein said body has a first end portion and opposite side portions and wherein said body has a opening in said first end portion thereof which forms said cavity; wherein said arm members are pivotally connected at one end thereof to said opposite side portions of said body; and wherein said blade members have a generally disk shaped configuration, are attached to said arm members to revolve about said axis of rotation and so that center points of said blade members are spaced from said axis of rotation.

18. An electrical connector for insulated cable comprising:

a) a body formed of an electrically insulating material, said body having a cavity formed therein sized to receive an unstripped end of insulated electrical cable having at least two individually insulated conductors which are encased in an outer sheath;

b) a pair of electrically insulating arm members pivotally connected to said body with said arm members adapted to rotate about an axis of rotation between an open position wherein said cavity is open to allow insertion of an electrical cable into said cavity and a closed position wherein said cavity is at least partially obstructed;

c) a pair of electrically conducting blade members attached to said arm members whereby when said arm members are in the open position said blade members do not extend within said cavity and when said blade arm members are in the closed position said blade members do extend within said cavity;

d) electrical output means located on said body; and e) electrical pathway means providing an electrical connection between said blade members and said electrical output means, wherein said cavity has a generally elongated cross sectional configuration and said cavity extends into the body along a centrally located longitudinal axis, wherein said body has a opening in said first end portion thereof which forms said cavity and wherein said cavity is more narrow in cross section at locations more distant from the opening, whereby an unstripped end of insulated electrical cable will be retained by a greater amount of friction as the cable is inserted deeper into the cavity.

* * * * *

UNITED STATES PATENT AND TRADEMARK OFFICE

CERTIFICATE OF CORRECTION

PATENT NO. : 5,975,938

DATED : November 2, 1999

INVENTOR(S) : Robert A. Libby

It is certified that error appears in the above-identified patent and that said Letters Patent is hereby corrected as shown below:

Column 2, line 17, "though" should read "through"
Column 2, line 26, "though" should read "through"
Column 2, line 35, "though" should read "through"
Column 4, line 3, "isolates" should read "isolate"
Column 4, line 3, "allows" should read "allow"
Column 4, line 43, "an" should read "and"
Column 5, line 20, delete "in"
Column 5, line 35, "at.," should read "al.,"
Column 6, line 6, "these" should read "those"
Column 6, line 18, delete "a"
Column 6, line 18, insert --is-- after"body"
Column 7, line 46, insert --is-- after"member"
Column 8, line 38, "cross section" should read "cross-sectional"
Column 8, line 65, "set" should read "said"
Column 10, line 6, "70, and 70'" should read "72, 72'"
Column 10, line 25, "as" should read "an"
Column 11, line 35, delete "blade"
Column 12, line 13, insert --of-- after "end"
Column 13, line 9, "a" should read "an"
Column 14, line 10, delete "blade"
Column 14, line 19, "a" should read "an"

Signed and Sealed this

First Day of May, 2001

*Attest:*

Nicholas P. Godici

NICHOLAS P. GODICI

*Attesting Officer*

*Acting Director of the United States Patent and Trademark Office*